US005401341A

United States Patent [19]

Forsberg et al.

[11] Patent Number: 5,401,341

[45] Date of Patent: Mar. 28, 1995

[54] CROSS-LINKED EMULSION EXPLOSIVE COMPOSITION

[75] Inventors: John W. Forsberg, Mentor; Nils O. Pearson, Lyndhurst, both of Ohio

[73] Assignee: The Lubrizol Corporation, Wickliffe, Ohio

[21] Appl. No.: 183,470

[22] Filed: Jan. 19, 1994

Related U.S. Application Data

[63] Continuation-in-part of Ser. No. 48,050, Apr. 14, 1993.

[51] Int. Cl.[6] ..... D03D 23/00; D03D 43/00; B01J 13/00

[52] U.S. Cl. ..... 149/46; 149/60; 149/108.8; 524/801; 44/271; 44/272; 44/301

[58] Field of Search ..... 149/45, 46, 60, 108.8; 524/801; 44/271, 272, 301

[56] References Cited

U.S. PATENT DOCUMENTS

| | | | |
|---|---|---|---|
| 3,130,096 | 4/1964 | Pruitt et al. | 149/19 |
| 3,177,101 | 4/1965 | Vriesen | 149/19 |
| 3,180,844 | 4/1965 | Dickerson | 260/30.6 |
| 3,790,416 | 2/1974 | Dehm | 149/19 |
| 4,039,636 | 8/1977 | Claus et al. | 260/963 |
| 4,104,092 | 8/1978 | Mullay | 149/2 |
| 4,216,040 | 8/1980 | Sudweeks et al. | 149/21 |
| 4,343,663 | 8/1982 | Breza et al. | 149/4 |
| 4,473,418 | 9/1984 | Bampfield et al. | 149/2 |
| 4,525,225 | 6/1985 | Cechanski | 149/19.5 |
| 4,708,753 | 11/1987 | Forsberg | 149/2 |
| 4,822,433 | 4/1989 | Cooper et al. | 149/2 |
| 5,244,475 | 9/1993 | Lownds | 44/271 |

FOREIGN PATENT DOCUMENTS

| | | |
|---|---|---|
| 0152184 | 8/1985 | European Pat. Off. . |
| 0250224 | 12/1987 | European Pat. Off. . |
| 0276934 | 8/1988 | European Pat. Off. . |
| 0393887 | 10/1990 | European Pat. Off. . |
| 1547376 | 6/1979 | United Kingdom . |
| 9101800 | 2/1991 | WIPO . |
| 9112485 | 8/1991 | WIPO . |

*Primary Examiner*—Donald P. Walsh
*Assistant Examiner*—Anthony R. Chi
*Attorney, Agent, or Firm*—John H. Engelmann; Frederick D. Hunter; David M. Shold

[57] ABSTRACT

This invention relates to water-in-oil emulsion explosives in which an oxidizing material is contained in the discontinuous water phase, and the continuous oil phase acts as a carbonaceous fuel. More particularly, this invention relates to such explosives in which polyfunctional carboxylic acids, sulfonic acids, or phosphorous-containing acids, soluble in the oil phase, are caused to cross-link using an inorganic cross-linker, thereby causing the viscosity of the emulsion to increase.

31 Claims, No Drawings

CROSS-LINKED EMULSION EXPLOSIVE COMPOSITION

This is a continuation-in-part of copending application Ser. No. 08/048,050, filed on Apr. 14, 1993.

BACKGROUND OF THE INVENTION

This invention relates to water-in-oil emulsion explosives in which an oxidizing material is contained in the discontinuous water phase, and the continuous oil phase acts as a carbonaceous fuel. More particularly, this invention relates to such explosives in which poly-functional carboxylic acids, sulfonic acids, or phosphorous-containing acids, soluble in the oil phase, are caused to cross-link, by in inorganic cross-linker, thereby causing the composition to increase in viscosity. Often the viscosity increase is sufficient to cause the composition to set to a rubbery consistency.

Water-in-oil explosive emulsions typically comprise a continuous organic phase and a discontinuous oxidizer phase containing water and an oxygen-supplying source such as ammonium nitrate, the oxidizer phase being dispersed throughout the continuous organic phase. Emulsion explosives are known to those skilled in the art. Cap-sensitive explosive emulsions are water-in-oil explosive emulsions which can be detonated without the use of a booster. Such emulsion explosives are also known to those skilled in the art.

U.S. Pat. No. 3,130,096 discloses a propellant composition in which a mixture of diglycidyl ethers is cured to form a binder which is admixed with an oxidizing material. The binder also functions as a fuel.

U.S. Pat. No. 3,177,101 discloses a gas-generating composition proposed by mixing a carboxyl terminated liquid polyester with ammonium nitrate powder and a curing agent. The curing agent reacts with the carboxyl portion of the liquid polyester, and the material sets to a solid consistency. The patent distinguishes between gas-generating compositions, propellants, and explosives by noting that gas-generating compositions have a substantially lower burning rate than conventional propellants, just as propellants have a substantially lower burning rate than explosives.

U.S. Pat. No. 3,790.,416 discloses a composite propellant composition in which dewetting of the propellant composition under applied stress is substantially reduced. Reduced dewetting is achieved through the use of poly-functional amines which are capable of forming a chemical bond between the oxidizer (oxygen-containing ammonium salt) and the binder in the cured propellant. The composite propellant composition comprises oxidizers and optionally fuels in the form of small solid particles uniformly distributed in a polymeric binder.

U.S. Pat. No. 4,104,092 discloses gelled explosive compositions which are sensitized with water-in-oil explosive emulsions. The gelled explosive compositions basically comprise an .aqueous solution of oxidizers, fuels and sensitizing agents which have been gelled with one or a variety of aqueous gelling agents such as guar gum and a suitable cross-linker. The patented compositions are distinguished from water-in-oil emulsion explosives in that emulsion explosives are comprised of two distinct phases, the carbonaceous oil being the continuous phase and the aqueous solution of the oxidizing agents being the discontinuous phase of the emulsion.

U.S. Pat. No. 4,216,040 discloses an inverted phase or water-in-oil blasting composition having a water-immiscible liquid organic fuel as a continuous phase, an emulsified aqueous inorganic oxidizer salt solution as a discontinuous phase, and an organic cationic emulsifier having a hydrophilic portion and a lipophilic portion, wherein the lipophilic portion is an unsaturated hydrocarbon chain. Thickening and cross-linking agents are not necessary for stability and water-resistancy. However, such agents can be added if desired. The aqueous solution of the composition can be rendered viscous by the addition of one or more thickening agents of the type and in the amount commonly employed in the art. Such thickening agents include galactomannin (preferably guar gums); guar gum of reduced molecular weight, biopolymer gums, polyacrylamide and analogous synthetic thickeners, flours, and starches. Cross-linking agents for cross-linking the thickening agents also are well known in the art. Such agents are usually added in trace amounts and usually comprise metal ions such as dichromate or antimony ions. The liquid organic, which forms the continuous phase of the composition, also can be thickened, if desired, by use of a thickening agent which functions in an organic liquid.

U.S. Pat. No. 4,343,663 discloses self-supporting, water-bearing explosive products which contain discreet cells of an aqueous solution of an inorganic oxidizing salt and/or an amine salt encapsulated by a cross-linked (thermoset) resin matrix.

U.S. Pat. No. 4,473,418 discloses an emulsion explosive composition which may include thickening and/or cross-linking agents. The typical thickening agents include natural gums, such as guar gum or derivatives thereof, and synthetic polymers, particularly those derived from acrylamide. Water-insoluble polymeric or elastomeric materials, such as natural rubber and synthetic rubber, may be incorporated into the oil phase. The cross-linking agents are not further specified.

U.S. Pat. No. 4,525,225 discloses a solid water-in-oil emulsion explosive comprising a discontinuous emulsion phase formed of an aqueous solution of an oxidizer salt and a continuous emulsion phase formed of a solid carbonaceous fuel derived from an oleaginous liquid.

U.S. Pat. No. 4,708,753 discloses that emulsion explosives may contain water phase or hydrocarbon phase thickeners such as guar gum, polyacrylamide, carboxymethyl or ethyl cellulose, biopolymers, starches, elastomeric materials and the like as well as cross-linkers for the thickeners, such as potassium pyroantimonate and the like.

U.S. Pat. No. 4,8221,433 discloses an explosive emulsion composition comprising a discontinuous phase containing an oxygen-supplying component and an organic medium forming a continuous phase wherein the oxygen-supplying component and organic medium are capable of forming an emulsion which, in the absence of a supplementary adjuvant, exhibits an electrical conductivity measured at 60° C., not exceeding 60,000 picomhos/meter. The conductivity may be achieved by the inclusion of a modifier which also functions as an emulsifier.

U.S. Pat. No. 5,244,475 discloses an emulsion composition with a polymerizing and/or cross-linking agent and method for its use in improving the manufacturing, packaging, transporting, storage placement and blasting characteristics of explosives containing an emulsion. More specifically, compositions and methods directed to controlling the rheology of an emulsion or explosive containing an emulsion by polymerizing and/or cross-linking the continuous phase oft the emulsion by employing hydroxy-terminated polybutadiene and polymerization agents and/or maleic anhydride adducted polybutadiene and cross-linking agents, but without compromising the integrity of the explosive reaction.

Accordingly, it is an object of the present invention to provide an emulsion explosive composition wherein the cross-linked substance is one or more poly-functional carboxylic acids, sulfonic acids, or phosphorous-containing acids, soluble in the oil phase, are caused to cross-link, by in inorganic cross-linker. It is a further object of this invention to provide an emulsion explosive composition which allows for the advantages of cross-linking while using an ordinary non-cross-linkable carbonaceous fuel as the continuous phase.

SUMMARY OF THE INVENTION

According to the present invention, an explosive emulsion is provided comprising: (A) a discontinuous aqueous oxidizer phase comprising at least one oxygen-containing component, (B) a continuous organic phase which comprises at least one carbonaceous fuel, (C) an emulsifying amount of an emulsifier suitable for forming a water-in-oil emulsion, (D) an oil-soluble acidic material suitable for cross-lifting, and (E) a suitable inorganic cross-linking agent provided that the emulsifier, component (C), may serve as the poly-functional acid suitable for cross-linking.

DETAILED DESCRIPTION OF INVENTION

This invention relates to an explosive emulsion in which an aqueous oxidizer phase is dispersed in a continuous oil, or fuel, phase. The oil phase also includes one or more poly-functional acids such as carboxylic acids, sulfonic acids, or phosphorous-containing acids. The poly-functional acids must be oil-soluble, and it must have more than one reactive site available for the cross-linking reaction. The emulsion is formed in the normal manner with the cross-linkable poly-functional acid dissolved in the oil phase. After the emulsion is formed, it is treated with an inorganic cross-linking agent so as to cause the poly-functional acidic molecules to cross-link. As a result of this cross-linking, the viscosity of the emulsion increases and it often sets up to a firm rubber like consistency. It is important to note that the continuous oil phase does not cross-link. Instead, the acidic molecules dissolved in the oil phase cross-link while the oil phase remains liquid. Although the oil is liquid, the fuel phase is thickened or even solidified by the cross-linked molecules dissolved therein. The cross-linked linked species thicken the oil phase, and thereby help to prevent coalescence of the discontinuous aqueous phase.

The present invention has major advantages over un-cross-linked emulsion explosives in that the explosives of the present invention can achieve viscosities which are difficult to achieve through the use of thickeners alone. If one adds thickeners to either phase of a conventional emulsion explosive, the liquids eventually become too thick to handle. Emulsification of such thickened liquid phases may be difficult if not impossible. On the other hand, an emulsion can be formed according to the present invention, and thickened to the desired degree by cross-linking after emulsion formation.

The present invention has an advantage over emulsion explosives in which organic cross-linking agents are used to cross-link organic molecules in the oil phase in that the inorganic cross-linkers are readily available, easier to handle and less costly than organic cross linkers.

The present invention has a major advantage over emulsion explosives in which the oil phase itself is cross-linked, e.g. oil phases made up of ethylenically cross-linkable molecules. It is less expensive to provide molecules within the oil phase which can cross-link than it is to provide an entire oil phase which is cross-linkable. In the present invention, the oil phase may be ordinary materials such as diesel oil since the cross-linking is provided by dissolved molecules. In addition, by selection of the polyfunctional material to be cross-linked, and the cross-linking agent, it is possible to control the rate at which the emulsion sets or becomes firm, after the mixing of the emulsion or the cross-linking agent. In fact, emulsions of the present invention may be used in overhead vertical boreholes. In this application, the emulsion is mixed with the cross-linking agent shortly before the mixture is injected into the borehole. The emulsion then quickly sets and will no longer drain from the borehole.

AQUEOUS OXIDIZER PHASE

The aqueous oxidizer phase generally consists of oxidizing salts dissolved in water. Such salts include ammonium, alkali metal and alkaline earth nitrates, chlorates, and perchlorates and mixtures of these salts. In one embodiment, inorganic oxidizer salt comprises principally ammonium nitrate, although up to about 25% by weight of the oxidizer phase can comprise either another inorganic nitrate (e.g., alkali or alkaline earth metal nitrate) or an inorganic perchlorate (e.g., ammonium perchlorate or an alkali or alkaline earth metal perchlorate) or a mixture thereof.

The aqueous oxidizer phase is preferably present at a level in the range of from about 70% to about 95% by weight, more preferably from about 80% to about 90% by weight based upon the total weight of the emulsion. The oxidizing salt is generally present at a level from about 70% to about 95% by weight, .preferably from about 85% to 92% by weight, and more preferably from about 87% to about 90% by weight based c,n the total weight of the aqueous oxidizer phase.

OIL PHASE

The oil phase is the continuous phase of the emulsion, and acts as the carbonaceous fuel in the emulsion explosive. The carbonaceous fuel that is useful in the emulsions of the invention can include most hydrocarbons, for example, paraffinic, olefinic, naphthenic, aromatic, saturated or unsaturated hydrocarbons, and is typically in the form of an oil or a wax or a mixture thereof. In general, the carbonaceous fuel is a water-immiscible, emulsifiable hydrocarbon that is either liquid or liquefiable at a temperature of up to about 95° C., and preferably between about 40° C. and about 75° C. Oils from a variety of sources, including natural and synthetic oils and mixtures thereof can be used. The oil that is useful in the inventive emulsions can be a hydrocarbon oil having viscosity values from about 20 SUS (Saybolt Universal Seconds) at 100° F. to about 2500 SUS at 100° F. Mineral oils having lubricating viscosities (e.g. SAE 5–90 grade) can be used.

Examples of useful oils include a white mineral oil available from Witco Chemical Company under the trade designation KAYDOL; a white mineral oil available from Shell under the trade designation ONDINA; and a mineral oil available from Pennzoil under the trade designation N-750-HT. Diesel fuel (e.g., Grade No. 2-D as specified in ASTM D-975) can be used as the oil.

Natural oils include animal oils and vegetable oils (e.g., castor oil, lard oil) as well as solvent-refined or acid-refined mineral lubricating oils of the paraffinic, naphthenic, or mixed paraffin-naphthenic types. Oils of lubricating viscosity derived from coal or shale are also useful. Synthetic lubricating oils may be used. These include hydrocarbon oils and halo-substituted hydrocarbon oils such as polymerized and interpolymerized olefins (e.g., polybutylenes, polypropylenes, propyleneisobutylene copolymers, chlorinated polybutylenes, etc.); alkyl benzenes (e.g., dodecylbenzenes, tetradecylbenzenes, dinonylbenzenes, di-(2-ethylhexyl)-benzenes, etc.); polyphenols (e.g., biphenyls, terphenyls, etc.); and the like. Alkylene oxide polymers and interpolymers and derivatives thereof where the terminal hydroxyl groups have been modified by esterification, etherification, etc., constitute another class of known synthetic lubricating oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$Oxo acid diester of tetraethylene glycol.

Another suitable class of synthetic lubricating oils comprises the esters of dicarboxylic acids (e.g., phthalic acid, succinic acid, maleic acid, azelaic acid, suberic acid, sebacic acid, fumaric acid, adipic acid, linoleic acid dimer, etc.) with a variety of alcohols (e.g., butyl alcohol, hexyl alcohol, dodecyl alcohol, 2-ethylhexyl alcohol, pentaerythritol, etc.). Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethyl-hexanoic acid, and the like.

Unrefined, refined and re-refined oils (and mixtures of each with each other) of the type disclosed hereinabove can be used in the emulsions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil.

Refined oils are similar to the unrefined oils except that they have been further treated in one or more purification steps to improve one or more properties. Many such purification techniques are known to those of skill in the art such as solvent extraction, acid or base extraction, filtration, percolation, etc. Re-refined oils are obtained by processes similar to those used to obtain refined oils applied to refined oils which have been already used in service. Such re-refined oils are also known as reclaimed or reprocessed oils and often are additionally processed by techniques directed to removal of spent additives and oil breakdown products.

It may be desirable to include small amounts of silicon oils as additives in the oil phase. These oils tend to make the composition more resistant to moisture in the environment. Useful silicon-based oils include materials such as the polyalkyl-, polyaryl-, polyalkoxy-, or polyaryloxy-siloxanes. For example the following specific materials may be used: hexyl-(4-methyl-2-pentoxy)di-siloxane, poly(methyl)-siloxanes, poly(methylphenyl)siloxanes.

The oil phase may contain any wax having melting point of at least about 25° C. and generally below 90° C., such as petrolatum wax, microcrystalline wax, and paraffin wax, mineral waxes such as ozocerite and montan wax, animal waxes such as spermaceti wax, and insect waxes such as beeswax and Chinese wax. Useful waxes include waxes identified by the trade designation MOBILWAX 57 which is available from Mobil Oil Corporation; D02764 which is a blended wax available from Astor Chemical Ltd.; and VYBAR which is available from Petrolite Corporation. Preferred waxes are blends of microcrystalline waxes and paraffin.

In one embodiment, the carbonaceous fuel includes a combination of a wax and an oil. In this embodiment the wax content can be at least about 25% to about 60% by weight of the oil phase, and the oil content can be at least about 40%.

The oil phase is generally present at a level from about 5% to about 30% by weight, preferably from about 10% to 20% by weight based on the total weight of the emulsion. The cross-linkable material is included in the weight of the oil phase, since it is dissolved in that phase, and serves to thicken that phase. The cross-linkable material makes up about 25 to 50% of the oil phase.

EMULSIFIER

Any water-in-oil emulsifier suitable for use with emulsion explosives is suitable for use in the present invention. The emulsifier serves to establish an emulsion in which water droplet,s containing the oxidizing material are dispersed in the continuous oil phase. The invention resides in the incorporation, within the oil phase, of cross-linkable materials which are cross-linked after the emulsion is formed. This cross-linking causes the continuous oil phase to thicken. Accordingly, any emulsifier which serves to establish the requisite water-in-oil emulsion and is stable to the conditions under which the emulsion is formed, may be used in the present invention. Such emulsifiers generally consist of molecules with both a hydrophilic and a lipophilic portion.

The lipophilic of the emulsifier may be either monomeric or polymeric in nature, provided that it contains a chain structure of sufficient length to confer the necessary emulsification characteristics. The chain structure should incorporate a backbone sequence of at least 10, and preferably not more than 500, linked atoms; these may be entirely carbon atoms, or they may be predominantly carbon atoms interrupted by heteroatoms such as oxygen or nitrogen. Desirably, the lipophilic portion includes a terminal reactive grouping, such as a hydroxyl, amino, carboxyl or carboxylic acid anhydride group, to promote linkage of the lipophilic portion to an appropriate hydrophilic portion.

A saturated or unsaturated hydrocarbon chain derived, for example, from a polymer of a mono-olefin, the polymer chain containing from 40 to 500 carbon atoms. Suitable polyolefins include those derived from olefins containing from 2 to 6 carbon atoms, in particular ethylene, propylene, butene-1 and isoprene, but especially isobutene. Conveniently, this portion of the molecule may be provided by a poly[alk(en)yl]succinic anhydride. These are commercially available materials which are made by an addition reaction at an elevated temperature between a polyolefin containing a terminal unsaturated group and maleic anhydride, optionally in the presence of a halogen catalyst. Typical poly(isobutylene)succinic anhydrides have a number average molecular weight in the range 400 to 5000. The succinic anhydride residue in the above-mentioned compounds provides a convenient means of attaching the lipophilic hydrocarbon chain to the hydrophilic moiety of the emulsifier.

The use of amine salts of derivatives of substituted succinic acylating agents as emulsifiers in emulsion explosives is disclosed in U.S. Pat. No. 4,708,753. Similarly, the alkali metal and alkaline earth metal salts of such derivatives are usable as emulsifiers.

Other suitable emulsifiers include sorbitan esters, such as sorbitan sesquioleate, sorbitan monooleate, sorbitan monopalmitate, sorbitan monostearate and sorbitan tristearate, the mono- and diglycerides of fat-forming fatty acids, soybean lecithin and derivatives of lanolin, such as isopropyl esters of lanolin fatty acids, mixtures of higher molecular weight fatty alcohols and wax esters, ethoxylated fatty ethers, such as polyoxyethylene(4) lauryl ether, polyoxyethylene(2) oleyl ether, polyoxyethylene(2) stearyl ether, polyoxyalkylene oleyl laurate, and substituted oxazolines such as 2-oleyl-4-4'-bis(hydroxymethyl)-2-oxazoline. Suitable mixtures of such conventional emulsifiers may also be selected. The emulsifier generally makes up between 0.5 to 2% of the total emulsion composition. Preferably the amount of the emulsifier ranges from 1 to 1.5% of the total composition.

CROSS-LINKABLE MATERIALS

The continuous oil phase of the emulsion contains a poly-functional acid suitable for cross-linking. The cross-linkable material is included in the weight of the oil phase, since it is dissolved in that phase, and serves to thicken that phase. This material makes up about 25 to 50% of the oil phase. These poly-functional acids have a lipophilic portion of the molecule which allows them to readily dissolve in the oil phase. The reactive acid sites allow them to react with the inorganic cross-linking agent to form large molecules which remain in the oil phase and have the effect of causing the entire emulsion to harden or stiffen.

The cross-linkable material may be any oil-soluble poly-functional acid which can readily react with the inorganic cross-linker to form a stable derivative and is sufficiently stable to survive the emulsion formation conditions. For example, the cross-linkable material may be a poly-functional carboxylic acid, sulfonic acid, or phosphorous-containing acid.

In selecting a poly-functional acid, care must be taken to insure that there is sufficient lipophilic character so that the material remains in the oil phase even during the exposure to the aqueous phase which occurs during the emulsification process. Accordingly, small molecules such as succinic acid would not be suitable as the poly-functional acid. However, substituted succinic acids which contain a lipophilic substituent are usable.

The lipophilic portion of the molecule may be a hydrocarbon chain formed by the polymerization of an olefin. Suitable olefins include ethylene, propylene, butene and hexene. However, the lipophilic portion of the molecule is not limited to polymerized olefins. More generally, the lipophilic portion of the molecule may be any hydrocarbyl group which can include:

(1) hydrocarbyl groups, that is, aliphatic (e.g., alkyl or alkenyl), alicyclic (e.g., cycloalkyl, cycloalkenyl), aromatic, aliphatic- and alicyclic-substituted aromatic groups and the like as well as cyclic groups wherein the ring is completed through another portion of the molecule (that is, any two indicated groups may together form an alicyclic group);

(2) substituted hydrocarbyl groups, that is, those groups containing non-hydrocarbon groups which, in the context of this invention, do not alter the predominantly hydrocarbyl nature of the hydrocarbyl group; those skilled in the art will be aware of such groups, examples of which include ether, oxo, halo (e.g., chloro and fluoro), alkoxyl, mercapto, alkylmercapto, nitro, nitroso, sulfoxy, etc.;

(3) hetero groups, that is, groups which, while having predominantly hydrocarbyl character within the context of this invention, contain other than carbon in a ring or chain otherwise composed of carbon atoms. Suitable heteroatoms will be apparent to those of skill in the art and include, for example, sulfur, oxygen, nitrogen and such substituents as pyridyl, furanyl, thiophenyl, imidazolyl, etc.

In general, no more than about three non-hydrocarbon groups or heteroatoms and preferably no more than one, will be present for each ten carbon atoms in a hydrocarbyl group. Typically, there will be no such groups or heteroatoms in a hydrocarbyl group and it will, therefore, be purely hydrocarbyl.

The hydrocarbyl groups are preferably free from acetylenic unsaturation; ethylenic unsaturation, when present will generally be such that there is no more than one ethylenic linkage present for every ten carbon-to-carbon bonds. The hydrocarbyl groups are often completely saturated and therefore contain no ethylenic unsaturation. Whatever the structure, the hydrocarbyl group provides oil solubility. It is the reactive portion of the molecule, that is, the acid groups which include carboxyl, sulfonic and phosphorous-containing acid groups which allow the molecule to undergo cross-linking.

Particularly favorable, cross-linkable materials are copolymers of maleic acid or maleic anhydride with various ethylenically unsaturated species, such as styrene and $C_{2-30}$ alkenes. Such copolymers include several carboxyl groups within the polymer chain. In one embodiment, these copolymers may be partially esterified with individual alcohols ($C_8$ to about $C_{30}$) or alcohol mixtures ($C_4$–$C_{50}$). Similar copolymers may be formed from methyacrylic acid, acrylic acid, crotonic acid and itaconic acid. The copolymers prepared with the various unsaturated acids all contain more than one acid group per molecule. The poly-acid may be partially esterified to forman acid containing ester which can function as the cross-linkable material. If the partial ester is further partially reacted with a base to form a partial salt, the acid/ester in its partially salted form may serve as the emulsifier. In this case, the remaining unreacted acid sites are available for the cross-linking reaction. The esterification and salt formation must be conducted so as to leave some available acid sites if the copolymer is to function as a cross-linkable material.

Suitable phosphorous-containing cross-linkable materials may be prepared by reacting a polyol with phosphorous pentoxide. The phosphorous pentoxide reacts to form phosphate esters of the polyol hydroxyl groups. The result is a part ester part acid which may be cross-linked in a manner similar to other poly-acid materials.

CROSS-LINKING AGENTS

The cross-linking agents are polyvalent inorganic species which react with the cross-linkable acids. Polyvalent metal ions are useful as inorganic cross-linking agents. Polyvalent ions such as magnesium, calcium, aluminum, and zinc are useful. Alkaline earth metal species are the preferred inorganic agents. For reasons of cost and availability, magnesium and calcium are the most preferred inorganic agents. The metals may be used in any form which will conveniently react with an acid species. The possible forms include oxides, hydroxides, carbonates, alcoholates, such as ethoxides, and other metal salts of weak acids. The oxide, hydroxide or carbonates are the preferred forms. Calcium tends to cause a faster cross-linking reaction than magnesium.

EXPLOSIVE COMPOSITIONS, ADDITIONAL COMPONENTS

Explosive emulsions typically contain other additives such as sensitizing components, oxygen-supplying salts, particulate light metals, particulate solid explosives, soluble and partly soluble self-explosives, explosive oils and the like for purposes of augmenting the strength and sensitivity or decreasing the cost of the emulsion.

The sensitizing components are distributed substantially homogeneously throughout the emulsions. These sensitizing components are preferably occluded gas bubbles which may be introduced in the form of glass or resin microspheres or other gas-containing particulate materials. Alternatively, gas bubbles may be generated in situ by adding to the composition and distributing therein a gas-generating material such as, for example, an aqueous solution of sodium nitrite. Other suitable sensitizing components which may be employed alone or in addition to the occluded or in-situ generated gas bubbles include insoluble particulate solid self-explosives such as, for example, grained or flaked TNT, DNT, RDX and the like, and water-soluble and/or hydrocarbon-soluble organic sensitizers such as, for example, amine nitrates, alkanolamine nitrates, hydroxyalkyl nitrates, and the like. The explosive emulsions of the present invention may be formulated for a wide range of applications. Any combination of sensitizing components may be selected in order to provide an explosive composition of virtually any desired density, weight-strength, or critical diameter.

The quantity of solid self-explosive ingredients and of water-soluble and/or hydrocarbon-soluble organic sensitizers may comprise up to about 40% by weight of the total emulsion. The volume of the occluded gas component may comprise up to about 50% of the volume of the total explosive emulsion.

Optional additional materials may be incorporated in the explosive emulsions of the invention in order to further improve sensitivity, density, strength, rheology and cost of the final explosive. Typical of materials found useful as optional additives include, for example, emulsion promotion agents such as highly chlorinated paraffinic hydrocarbons, particulate oxygen-supplying salts such as prilled ammonium nitrate, calcium nitrate, perchlorates, and the like, particulate metal fuels such as aluminum, silicon and the like, particulate non-metal fuels such as sulfur, gilsonite and the like, particulate inert materials such as sodium chloride, barium sulphate and the like, water phase thickeners such as guar gum, polyacrylamide, carboxymethyl or ethyl cellulose, biopolymers, starches, and the like, buffers or pH controllers such as sodium borate, zinc nitrate and the like, and additives of common use in the explosives art.

The explosive emulsions may be formed by methods well known to those skilled in the art. One common method is to mix the emulsifier with the oil phase to form an emulsifiable oil phase. The salts and other water soluble components, if any, are mixed with water at an elevated temperature sufficient to cause the formation of a solution. The oil and the aqueous phase are brought together and mixed at a low shear rate to form a pre-emulsion and then at a higher rate to form the final emulsion. Suspended components such as sensitizers, added fuels, and added oxidizers may be added after the emulsion is formed.

Although the invention is not limited to a particular method of forming the emulsion and addition of the cross-linking agent, it is generally advantageous to form the emulsion first and then conduct the cross-linking reaction. With most cross-linking agents, the final emulsion is formed and then stirring is continued to introduce the cross-linking agent into the system. In certain cases, it is desirable to prepare the emulsion, transport it to the site where it is to be used and introduce the cross-linking agent as the emulsion is being placed for use. This procedure would be especially applicable to mining situations where it is desired to have an emulsion which can be pumped into a hole, but which sets shortly after it is put in place. Overhead vertical boreholes would be an example of such a situation.

EXAMPLE

Aqueous phase: A mixture of 628 g. of $NH_4NO_3$, 85.6 g. of $NaNO_3$, and 86.4 g. of $H_2O$ was heated to 220°–225° F. (104.4°–107.2° C.). At this temperature a uniform solution was obtained. Five drops of a concentrated aqueous solution of $NH_4OH$ was added to bring the pH into the range of 4–6.

Oil phase: The cross-linkable material was formed by esterifying a maleic anhydride/styrene co-polymer, (MW = 100,000), with a combination of a $C_{12-18}$ alcohol mixture and a $C_{8-10}$ alcohol mixture. For each equivalent of carboxylic acid, 0.64 equivalents of the $C_{12-18}$ alcohol mixture and 0.17 equivalents of the $C_{8-10}$ alcohol mixture were used in the esterification reaction. The reaction product was an ester with unreacted carboxylic acid groups, contained 51% diluent oil, and had an acid equivalent weight of 3900 grams. 150 Grams of this reaction product was mixed with 49 g. of 100 neutral oil and 1 g. of diethylethanolamine. The mixture was heated to 190°–195° F. (87.8°–90.6° C.). The product, which served as the emulsifier, was an amine salt.

Emulsion: 800 Grams of the aqueous phase at a temperature of 220°–225° F. (104.4°–107.2° C.) was added over a 3–4 minute period to 200 g. of the oil phase in a 1.5 quart container. During the addition, the mixture was subjected to low shear stirring. A low viscosity invert emulsion formed. This emulsion was stirred under higher shear conditions to form the final emulsion. The Brookfield viscosity of this emulsion (20 rpm, #7 spindle) was 170,000 cP at 170° F. (76.7° C.).

Cross-linking:

1-A A 500 g. sample of the emulsion formed above (containing 0.02 carboxy acid equivalents) was blended with 0.60 g. of $Mg(OH)_2$ (0.02 equivalents) at 170° F. (76.7° C.). One hour after mixing, the cross-linked emulsion was firmer than the original emulsion. While the original emulsion was soft, rubbery and tacky, the cross-linked emulsion was firmer, rubbery, and dry to the touch. The cross-linked emulsion was unchanged after 6 months of retention at room temperature.

1-B A similar sample of the emulsion formed above was treated with a stoichiometric amount of $Ca(OH)_2$ at 170° F. (76.7° C.). The cross-linked emulsion became very firm, rubbery and dry within one minute after mixing. The cross-linked emulsion was unchanged after 5 months of retention at room temperature.

We claim:

1. An explosive emulsion comprising: (A) a discontinuous aqueous oxidizer phase comprising at least one oxygen-containing component, (B) a continuous organic phase which comprises at least one carbonaceous fuel, (C) an emulsifying amount of an emulsifier suitable for forming a water-in-oil emulsion, (D) an oil-soluble polyfunctional acidic material suitable for cross-linking, and (E) a suitable polyvalent inorganic cross-linking agent, provided that the emulsifier, component (C), may serve as the poly-functional acid suitable for cross-linking.

2. An explosive emulsion according to claim 1 wherein the cross-linking agent is selected from the group consisting of magnesium, calcium, aluminum, zinc oxides, carbonates, and hydroxides.

3. An explosive emulsion according to claim 1 wherein the oil-soluble material suitable for cross-linking is a poly-functional carboxylic acid.

4. An explosive emulsion according to claim 3 wherein the emulsifier is selected from the group consisting of one or more salts of a substituted succinic acylating agent, sorbitan esters, oxazoline emulsifiers, salts of partially esterified poly-acids.

5. An explosive emulsion according to claim 4 wherein the cross-linking agent is selected from the group consisting of calcium and magnesium oxides, hydroxides and carbonates.

6. An explosive emulsion according to claim 3 wherein the emulsifier is one or more salts of a succinic acylating agent.

7. An explosive emulsion according to claim 6 wherein the cross-linking agent is a selected from the group consisting of calcium and magnesium oxides, hydroxides and carbonates.

8. An explosive emulsion according to claim 3 wherein the emulsifier is a sorbitan ester.

9. An explosive emulsion according to claim 8 wherein the cross-linking agent is selected from the group consisting of calcium and magnesium oxides, hydroxides and carbonates.

10. An explosive emulsion according to claim 3 wherein the emulsifier is a salt of a partially esterified poly-acid.

11. An explosive emulsion according to claim 10 wherein the cross-linking agent is selected from the group consisting of calcium and magnesium oxides, hydroxides and carbonates.

12. An explosive emulsion according to claim 1 wherein the oil-soluble material suitable for cross-linking is a polyfunctional phosphorous-containing acid.

13. An explosive emulsion according to claim 12 wherein the emulsifier is selected from the group consisting of one or more salts of a substituted succinic acylating agent, sorbitan esters, oxazoline emulsifiers, salts of partially esterified poly-acids.

14. An explosive emulsion according to claim 13 wherein the cross-linking agent: is selected from the group consisting of calcium and magnesium oxides, hydroxides and carbonates.

15. An explosive emulsion according to claim 12 wherein the emulsifier is one or more salts of a succinic acylating agent.

16. An explosive emulsion according to claim 15 wherein the cross-linking agent is selected from the group consisting of calcium and magnesium oxides, hydroxides and carbonates.

17. An explosive emulsion according to claim 12 wherein the emulsifier is a sorbitan ester.

18. An explosive emulsion according to claim 17 wherein the cross-lifting agent is selected from the group consisting of calcium and magnesium oxides, hydroxides and carbonates.

19. An explosive emulsion according to claim 12 wherein the emulsifier is a salt of a partially esterified polyacid.

20. An explosive emulsion according to claim 19 wherein the cross-linking agent is a selected from the group consisting of calcium and magnesium oxides, hydroxides and carbonates.

21. An explosive emulsion according to claim 1 wherein the oil-soluble material suitable for cross-linking is a polyfunctional sulfonic acid.

22. An explosive emulsion according to claim 21 wherein the emulsifier is selected from the group consisting of one or more salts of a substituted succinic acylating agent, sorbitan esters, oxazoline emulsifiers, salts of partially esterified poly-acids.

23. An explosive emulsion according to claim 22 wherein the cross-linking agent is selected from the group consisting of calcium and magnesium oxides, hydroxides and carbonates.

24. An explosive emulsion according to claim 21 wherein the emulsifier is one or more salts of a succinic acylating agent.

25. An explosive emulsion according to claim 24 wherein the cross-linking agent is selected from the group consisting of calcium and magnesium oxides, hydroxides and carbonates.

26. An explosive emulsion according to claim 21 wherein the emulsifier is a sorbitan ester.

27. An explosive emulsion according to claim 26 wherein the cross-linking agent is selected from the group consisting of calcium and magnesium oxides, hydroxides and carbonates.

28. An explosive emulsion according to claim 21 wherein the emulsifier is a salt of a partially esterified polyacid.

29. An explosive emulsion according to claim 27 wherein the cross-linking agent is selected from the group consisting of calcium and magnesium oxides, hydroxides and carbonates.

30. An explosive emulsion according to claim 1 comprising in addition a self-explosive material.

31. An explosive emulsion according to claim 1 in which the carbonaceous fuel is a hydrocarbon oil having a viscosity of between 20 and 2500 SUS at 100° F.

* * * * *